US005314093A

United States Patent [19]

Gross et al.

[11] Patent Number: 5,314,093

[45] Date of Patent: May 24, 1994

[54] TOGGLE-ACTION DISPENSING CLOSURE WITH ROTATABLE LOCKING RING

[75] Inventors: Richard A. Gross, Oconomowoc, Wis.; John R. Nottingham, Moreland Hills; Dale A. Panasewicz, Strongsville, both of Ohio

[73] Assignee: AptarGroup, Inc., Crystal Lake, Ill.

[21] Appl. No.: 951,871

[22] Filed: Sep. 25, 1992

[51] Int. Cl.[5] ..... B67D 5/00

[52] U.S. Cl. ..... 222/153; 222/534; 222/536; 222/556; 215/235

[58] Field of Search ..... 222/153, 531-537, 222/556, 402.11; 215/235

[56] References Cited

U.S. PATENT DOCUMENTS

| | | | |
|---|---|---|---|
| 3,007,614 | 11/1961 | Morrow | 222/490 |
| 3,776,428 | 12/1973 | Hazard | 222/153 |
| 3,782,577 | 1/1974 | Levey | 222/534 X |
| 4,047,643 | 9/1977 | Hazard | 222/153 |
| 4,065,036 | 12/1977 | Kirk, Jr. | 222/153 |
| 4,412,634 | 11/1983 | Bennett | 222/519 |
| 4,487,342 | 12/1984 | Shy | 222/481.5 |
| 4,542,837 | 9/1985 | Rayner | 222/402.11 |
| 4,763,801 | 8/1988 | Nycz | 222/153 X |
| 4,773,567 | 9/1988 | Stoody | 222/153 |
| 4,776,501 | 10/1988 | Ostrowsky | 222/517 |
| 4,838,460 | 6/1989 | Moore et al. | 222/153 |
| 4,941,580 | 7/1990 | Julian | 215/235 |
| 4,962,869 | 10/1990 | Gross et al. | 222/153 |
| 4,972,974 | 11/1990 | Chavkin et al. | 222/153 |
| 4,982,882 | 1/1991 | Gueret | 222/531 |
| 5,004,127 | 4/1991 | Morel | 222/521 |
| 5,065,912 | 11/1991 | Rosenthal | 222/517 |

FOREIGN PATENT DOCUMENTS

| | | | |
|---|---|---|---|
| 2120079 | 11/1972 | Fed. Rep. of Germany . | |
| 2541749 | 8/1984 | France | 222/153 |

*Primary Examiner*—Andres Kashnikow
*Assistant Examiner*—Anthoula Pomrening
*Attorney, Agent, or Firm*—Dressler, Goldsmith, Shore & Milnamow, Ltd.

[57] ABSTRACT

A toggle-action container dispensing closure is provided for manipulation between a closed, non-dispensing orientation and an open, dispensing orientation. The closure includes an actuator mounted on a body secured to the container. The actuator is tiltable between a closed position and an open position, and the actuator has an engaging tab. A locking ring is mounted on the body for rotation relative to the body and actuator. The ring defines an abutment member for engaging the actuator engaging tab. In one position, the locking ring abutment member lies under the actuator engaging the tab to prevent pivoting of the actuator to the open position. When the locking ring is rotated to another position, the locking ring abutment member clears the actuator engaging tab to permit pivoting of the actuator to the open position.

12 Claims, 3 Drawing Sheets

TOGGLE-ACTION DISPENSING CLOSURE WITH ROTATABLE LOCKING RING

TECHNICAL FIELD

This invention relates to a container toggle-action dispensing closure which can be manipulated between a closed orientation and an open, dispensing orientation. More particularly, this invention provides an improvement for reducing the likelihood of such a closure being inadvertently opened when subjected to arbitrary external forces.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a toggle-action actuator, flip-up spout, or nozzle assembly for dispensing the container contents. See, for example, U.S. Pat. Nos. 5,058,775 4,962,869, 4,776,501, 4,645,086 and 3,516,581.

The toggle-action closures, such as those disclosed in the above-referenced U.S. Pat. Nos. 5,058,775, 4,962,869, and 4,776,501, require that the operator push down on a top, rear portion of the closure in order to pivot the actuator portion of the closure to the dispensing orientation.

On the other hand, U.S. Pat. No. 4,838,460 discloses a closure in which a tiltable actuator is mounted within a rotatable collar, and rotation of the collar operates through a cam ring to tilt the actuator between the closed and open positions.

While the above-discussed closures may function generally satisfactorily for the purposes for which they were designed, it would be desirable to provide an improved dispensing closure with structural and operational advantages.

For example, during shipping, storage, and handling, a closure installed on a container may be inadvertently or accidentally subjected to external forces which cause it to be moved to the open, dispensing position. This can result in spillage of the contents and/or damage of the container as a saleable item.

Some closures, such as those discussed in some of the above-referenced patents, include frangible structures for preventing premature actuation and/or providing evidence of actuation. However, after such closures have been initially opened the first time, the closures can be subsequently opened to the dispensing position whenever a portion of the closure is intentionally or accidentally subjected to an external force.

Accordingly, it would be desirable to provide an improved closure in which the likelihood of inadvertent, premature opening of the closure is eliminated or substantially reduced. Further, it would be beneficial if such an improved closure could operate to prevent inadvertent opening, while at the same time permitting deliberate opening, without damage to the closure.

Also, it would be advantageous if such an improved closure could be incorporated in a design having an aesthetically pleasing, "high style," exterior configuration substantially free of functional details and outwardly projecting features. Specifically, it would be desirable to provide an improved closure in which the features for preventing inadvertent opening could be substantially contained within a compact, stream-lined profile of the closure.

Further, it would be advantageous if the components of such an improved design could be relatively easily manufactured and readily assembled.

Finally, it would be desirable to provide an improved design which would accommodate the torque encountered either during application of the closure to a container in an automatic, high-speed, capping machine or during use of the closure by a person who may inadvertently or intentionally apply an unusually high torque to the closure.

The present invention provides an improved closure which can accommodate designs having the above-discussed benefits and features.

SUMMARY OF THE INVENTION

The present invention provides a novel, toggle-action dispensing closure which can have a contemporary, clean design with virtually all features contained within an aesthetically pleasing profile and with virtually no visible functional details or instructional nomenclature.

The closure also includes a lock for preventing, or reducing the likelihood of, an inadvertent, premature opening or actuation of the closure to the dispensing position.

The closure components can be relatively easily manufactured and readily assembled. The design can accommodate significant torque that could be applied to the closure during application of the closure to a container with an automatic capping machine.

The closure is adapted to be mounted over the opening in a container, especially a container of the type having a generally flexible wall portion which can be squeezed to assist in dispensing the contents from the container.

The closure includes a body for engaging the container over the opening. An actuator means is provided on the body for occluding the flow from the container when the actuator means is in a closed, non-dispensing position and for permitting flow from the container when the actuator means is tilted to an open dispensing position. The actuator means includes an engaging surface.

The body and actuator means together define a mounting means for pivotably mounting the actuator means on the body to accommodate pivoting movement of the actuator means between the closed and open positions in response to a force applied to the actuator means while preventing substantial relative rotational movement between said body and actuator means about a central axis.

A locking ring is mounted on the body for rotation relative to the body and actuator means for movement about the central axis. The ring defines an abutment surface. Rotation of the ring to a first orientation carries the abutment surface into alignment with the actuator means engaging surface to prevent tilting of the actuator means to the open dispensing position. Rotation of the ring away from the first orientation carries the abutment surface out of alignment to permit tilting of the actuator means to the open dispensing position.

The locking ring can be designed to be selectively moved between the locked and unlocked positions without damaging the closure, and all of the features can be contained within a compact profile.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figure 1:
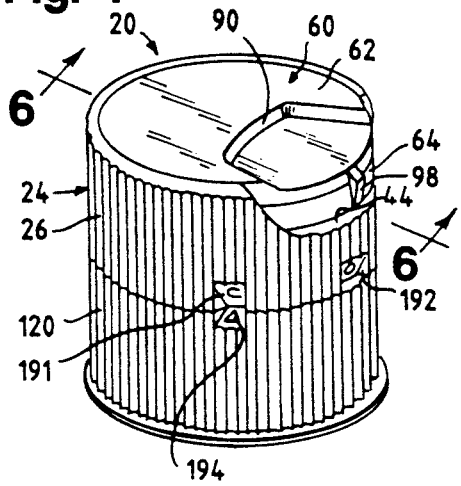
FIG. 1 is a perspective view of the closure of the present invention shown in a locked, non-dispensing, closed orientation.

FIG. 1 shows an embodiment of the dispensing closure of the present invention in the locked closed, non-dispensing position wherein the closure is represented generally by reference numeral 20. The closure 20 is adapted to be mounted on a container (not illustrated) which may have a conventional open mouth defined by a neck (not illustrated) or other suitable structure.

The closure 20 includes a closure base or body 24 (FIG. 4) for securement to the container. The body 24 includes a generally cylindrical, peripheral, upper wall 26 and a generally cylindrical, reduced-diameter, lower wall 27. A generally transverse closure wall or deck 28 (FIGS. 4, 6, and 8) extends across the body 24 between the upper wall 26 and lower wall 27.

Figure 6:
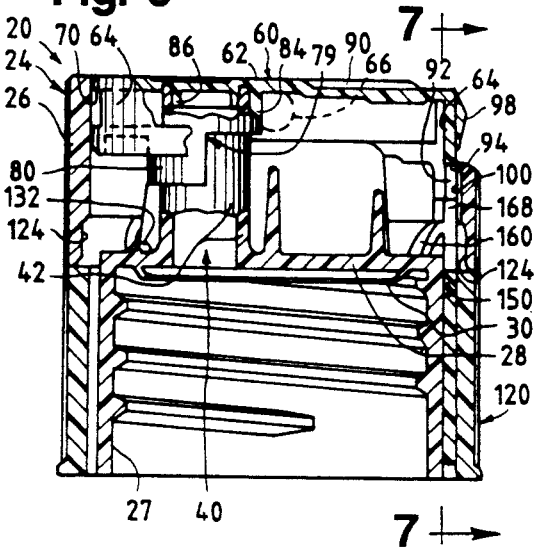
FIG. 6 is a greatly enlarged, cross-sectional view taken generally along the plane 6—6 in FIG. 1.
Figure 8:
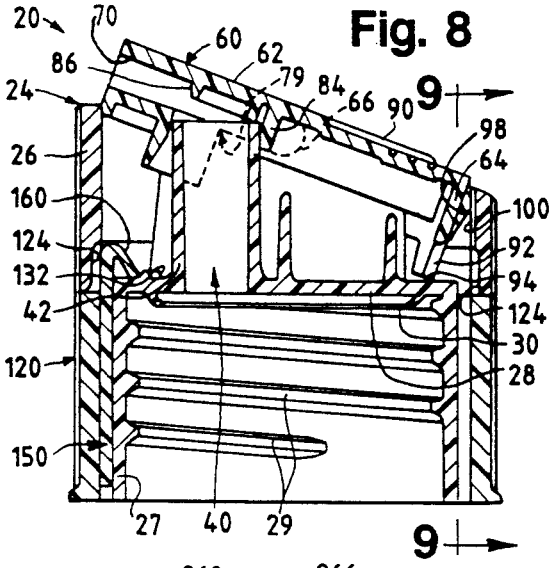
FIG. 8 is a greatly enlarged, cross-sectional view taken generally along the plane 8—8 in FIG. 2.

The lower, cylindrical wall 27 of the closure body 24 is adapted to engage the outer periphery of the top of the container neck (not illustrated) around the container mouth, as with threads 29 (FIGS. 6 and 8). Other suitable engaging means (e.g., snap-fit beads) may be provided to secure the closure body 24 on the container. Alternatively, in some applications the closure body 24 could be non-releasably attached to, or formed unitary with, the container.

An annular sealing ring 30 may be provided as shown in FIGS. 6 and 8 for engaging an interior edge of the container neck at the container mouth to effect a tight seal.

The closure body 24 includes a discharge aperture or passage 40 through the deck 28 as best illustrated in FIGS. 4, 5, 6, and 8. In the preferred embodiment, the closure body 24 includes a discharge tube 42 projecting upwardly from the deck 28, and the discharge aperture 40 is defined within, and through, the tube 42. The discharge aperture 40 in the tube 42 communicates through the deck 28 with the container interior at the lower end of the tube 42.

As shown in FIGS. 1 and 6, the cylindrical, upper wall 26 of the closure body 24 extends upwardly above, and around, the closure body deck 28. A rear portion of the wall 26 above the deck 28 defines a fingerwell or finger recess area 44 in the form of a cutout or notch in the top edge of the wall 26.

Figure 2:
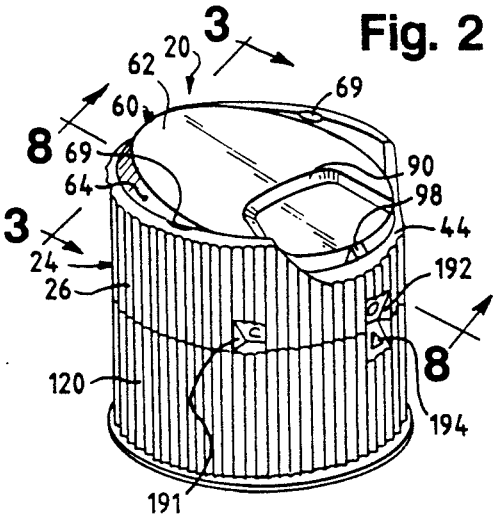
FIG. 2 is a perspective view of the closure shown in an unlocked, open, dispensing orientation.
Figure 3:
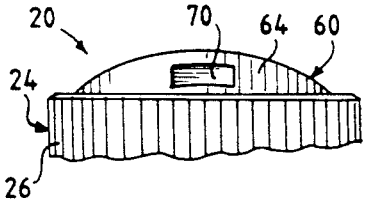
FIG. 3 is a fragmentary, front elevational view of the closure in the open orientation shown in FIG. 2 as taken generally along the plane 3—3 in FIG. 2.
Figure 4:
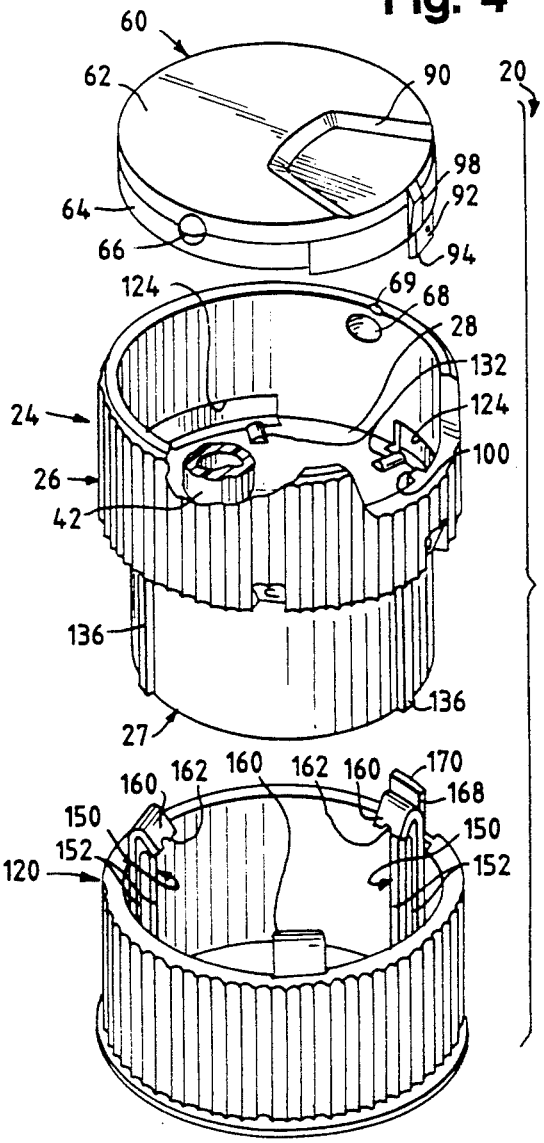
FIG. 4 is an enlarged, exploded, perspective view of the closure with portions of the structure cut away to illustrate interior detail.

The closure body 24 receives a generally disc-like nozzle assembly, actuator means, or actuator 60. The actuator 60 includes a transverse top wall 62 and a peripheral flange 64 (FIGS. 1, 2, 3, 4, 5, and 6). At each of two diametrically opposed portions of the flange 64 there is a projecting, hemispherical protuberance or pivot member 66 (FIGS. 4, 6, and 8).

The pivot members 66 cooperate with the closure body upper wall 26 to mount the actuator 60 for pivoting movement within the closure body 24. To this end, the inner surface of the closure body wall 26 defines two hemispherical recesses 68 (FIGS. 5 and 6) for each mating with one of the pivot members 66 to provide a snap-action engagement of the pivot member 66. This accommodates the pivoting movement of the actuator 60 about a pivot axis defined by the pivot members 66 and receiving recesses 68.

The top edge of the wall 26, above each recess 68, is preferably provided with a chamfer 69 for facilitating assembly. When the body 24 and actuator 60 are assembled, the actuator pivot members 66 and body recesses 68 function as mounting means so that the actuator 60 can be pivoted (by pushing downwardly on the rear portion of the actuator 60) until the forward end is exposed above the closure body wall 26 as illustrated in FIGS. 2, 3, and 8.

The actuator 60 includes a structure on the bottom surface of the top wall 62 which functions——depending upon the orientation of the actuator 60——to either permit dispensing of flowable material from the body discharge tube 42 or occlude the tube passage 40 so as to prevent flow out of the discharge tube 42. In particular, as shown in FIGS. 3, 6 and 8, the actuator 60 includes a forwardly extending nozzle or channel 70 which merges with, and opens into, a stepped, cylindrical sealing wall 79.

The wall 79 surrounds and seals the upper periphery of the discharge tube 42 when the actuator 60 is in the closed position as illustrated in FIG. 6. In particular, the wall 79 forms a seal around the outer periphery of the discharge tube 42 as indicated by reference number 80 at the front of the tube 42 and as indicated by the reference numeral 84 at the rear of the tube 42.

Preferably, a sealing plug 86 projects downwardly from the bottom of the actuator top wall 62. The sealing plug 86 has a generally cylindrical or annular configuration and is adapted to enter into the opening at the top of the discharge tube 42 to sealingly occlude the discharge aperture 40 in the tube 42 when the actuator is in the closed position as illustrated in FIG. 6.

On the other hand, when the rear of the actuator 60 is pushed down to tilt the actuator to the dispensing position as illustrated in FIG. 8, then the front portion of the sealing plug 86 is tilted away from the top of the discharge tube 42 to permit flow of the material out of the discharge aperture in the tube 42 and through the dispensing nozzle 70. When the actuator 60 is tilted to the dispensing position as illustrated in FIG. 8, the wall 79 still continues to seal the outer periphery of the upper end of the discharge tube 42 so that the container contents, while being dispensed into the nozzle 70, cannot leak out around the top of the discharge tube 42.

The actuator 60 can be pivoted to the open position by applying a downwardly directed force at a location on the top of the actuator 60. To this end, a rear portion of the actuator top wall 62 is recessed within a downwardly sloping surface 90 (FIGS. 1, 2, and 4) for receiving the end of a thumb or finger.

A locking tab 92 projects downwardly from the bottom of the peripheral flange 64 at the rear of the actuator 60. The locking tab 92 defines a downwardly facing engaging surface 94.

An angled cam 98 projects rearwardly from the outer, vertical surface of the actuator flange 64 at the rear of the actuator 60. As illustrated in FIGS. 4, 5, 6, and 8, the closure body cylindrical, upper wall 26 defines a small vertically oriented rib 100 which is radially aligned with the cam 98 on the back of the actuator 60. When the actuator 60 is tilted to the dispensing position (FIGS. 2 and 8), the most rearwardly extending portion of the cam 98 frictionally engages the rib 100. The cam 98 thus serves to stabilize the actuator 60 as it is being pivoted, and the cam 98 provides a frictional engagement to maintain the actuator in the tilted, open position. The actuator 60 can be returned to the closed position by pushing down on the front part of the actuator.

A novel twist ring or locking ring 120 is adapted to be mounted to the closure body 24 for rotation relative to both the closure body 24 and container on which the closure body 24 is mounted. To this end, the closure body 24 is provided with a novel configuration for receiving and retaining the locking ring 120. In particular, the closure body 24 defines three arcuate slots 124 (two of which are visible in FIGS. 4, 5, 6, and 8). Preferably, the three slots 124 each have the same arc length and are equally spaced around the periphery of the closure body deck 28. A portion of each slot 124 extends radially inwardly into the deck 28, and a portion of each slot extends upwardly into a portion of the peripheral, upper, cylindrical wall 26. Because the closure body lower, cylindrical wall 27 has a smaller diameter than the upper wall 26, the slots 124 are open downwardly along side the closure deck 28 at the exterior surface of the lower, cylindrical wall 27. Adjacent each slot 124 there is a semi-cylindrical protuberance 132 projecting upwardly from the top surface of the closure body deck 28.

On the exterior surface of the closure body cylindrical, lower wall 27 there are three, peripherally spaced, outwardly projecting ribs 136 for engaging the locking ring 120 as explained in detail hereinafter.

Figure 7:
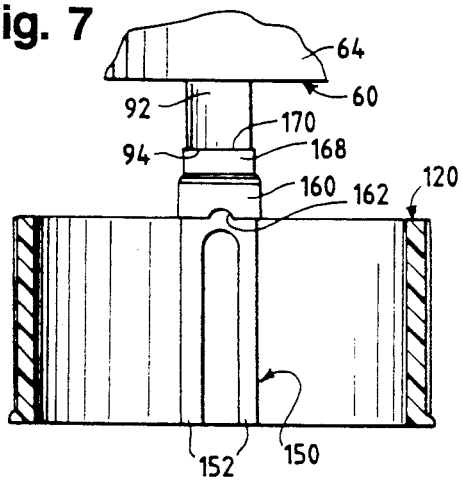
FIG. 7 is a fragmentary, cross-sectional view taken generally along the plane 7—7 FIG. 6 with the body omitted for ease of illustration.
Figure 9:
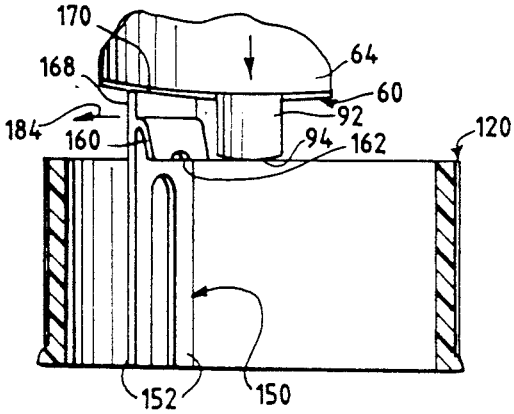
FIG. 9 is a fragmentary, cross-sectional view taken generally along the plane 9—9 in FIG. 8 with the body omitted for ease of illustration.

The locking ring 120 has a generally cylindrical configuration. On the inside of the ring 120 there are three rib structures 150, and each rib structure 150 has two downwardly extending, and inwardly projecting, legs or ribs 152 (FIGS. 4, 7, and 9). At the top of the ring 120, the two ribs 152 which form the legs of each rib structure 150 merge and define an inverted, U-shaped or hook-shaped clip 160. Each clip 160 has an inwardly and downwardly projecting distal end for engaging the body deck 28. The bottom of the distal end of each clip 160 defines a semi-cylindrical recess 162 for receiving one of the semi-cylindrical protuberances 132.

As can be seen in FIGS. 4, 5, 6, 7, and 9, an abutment tab 168 projects upwardly from one of the three clips 160. The top of the abutment tab 168 defines an upwardly facing abutment surface 170 for being engaged by the downwardly facing engagement surface 94 of the actuator locking tab 92.

The locking ring 120 can be assembled with the closure body 24 before or after the actuator 60 has been mounted in the closure body 24. To this end, the locking ring 120 is aligned with the closure body cylindrical, lower wall 27, and then relative axial displacement is effected between the closure body 24 and the locking ring 120 so as to position each locking ring clip 160 in a closure body slot 124. During this assembly process, the distal ends of the clips 160 are temporarily distorted and compressed in the radially outward direction so as to accommodate movement into and through the slots 124. When the bottom of the downturned distal end of each clip 160 clears the top surface of the closure body deck 28, the clip 160 springs radially inwardly to its original, undeformed condition. The distal end of each clip 160 thus extends inwardly over, and engages, the closure body deck 28. This serves to retain the locking ring 120 on the closure body 24 while permitting the relative rotation between the ring 120 and the body 24.

Figure 5:
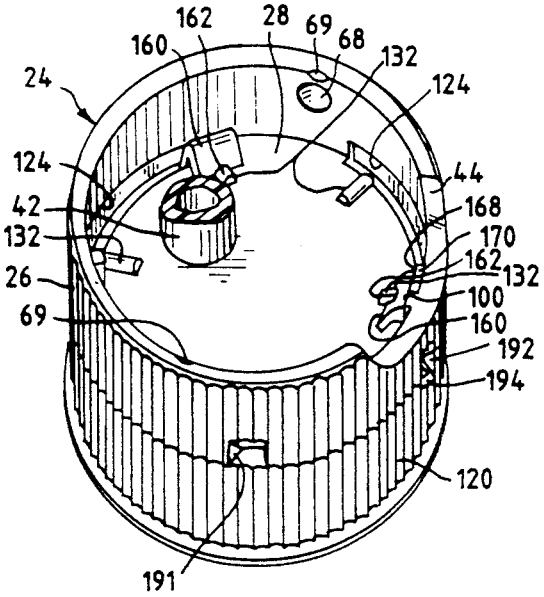
FIG. 5 is a perspective view of the closure with the actuator removed to reveal interior detail.

Selected rotational positions of the locking ring 120 can be indicated or established by means of a low force, snap-fit engagement between each clip 160 and one of the semi-cylindrical protuberances 132 which project upwardly from the closure body deck 28. In particular, as can be seen in FIG. 5, two of the locking ring clips 160 are each positioned over, and in engagement with, a protrusion 132. To this end, each clip 160 is resiliently deformable upwardly away from the deck 28, and each clip recess 162 matingly receives a deck protrusion 132. This provides resistance to further rotation of the ring 120 in either direction, and this provides a tactile sensation indicating that the ring 120 is at a desired rotational orientation.

In one rotated position, the ring 120 is oriented so that the upwardly projecting abutment member 168 is positioned beneath the actuator engaging tab 92 (FIGS. 6 and 7). In this position, the actuator tab engaging surface 94 engages the locking ring tab abutment surface 170 to prevent the actuator 60 from being tilted to the open position. The locking ring 120 is releasably held in this position by the engagement between the locking ring clips 160 and the closure body deck protrusions 132.

The locking ring 120 can be rotated from the locked position (FIGS. 6 and 7) to an unlocked position (FIGS. 8 and 9) by rotating the ring 120 in the direction of the arrow 184 as viewed in FIG. 9 (clockwise when looking down on the closure as in FIG. 2). As soon as the ring 120 moves the abutment tab 168 an amount sufficient to clear the actuator tab 92, the actuator 60 can be tilted to the open position (FIG. 8).

Preferably, relative rotation between the closure body 24 and ring 120 is effected to establish a predetermined, relative angular orientation between the two components at which the actuator 60 can be tilted open. To this end, each of the ring clips 160 is adapted to engage one of the closure body deck protuberances 132 when the abutment tab 168 and engaging tab 92 are in a non-engaging, non-aligned relationship (FIG. 9). The engagement of each clip 162 with a closure body deck protuberance 132 again provides a resistance to further relative movement between the ring 120 and closure 24. This serves to provide a tactile indication that the components have been moved to the end of the movement range which permits tilting of the actuator 60 to the open position.

In the illustrated embodiment, where the closure body 24 is provided with threads 29 for threadingly engaging mating threads on a container neck (not illustrated), the closure body ribs 136 and ring ribs 152 facilitate the screwing of the closure onto the container with or without an automatic capping machine. In particular, the locking ring 120 can be gripped, as with the head of an automatic capping machine, to align the closure, and hence the closure body lower wall 27, with the container neck. As the closure body threads 29 engage the threads on the container neck, the capping machine rotates the locking ring 120 (in a clockwise direction when viewing downwardly on the top of the closure). The locking ring ribs 152 move with the ring relative to the closure body 24 until the leading ribs 152 engage the ribs 136 on the closure body lower wall 27. This establishes a driving engagement between the locking ring 120 and closure body 24 which threads the closure tightly onto the container with the abutment member 168 maintained under the actuator tab 92 so as to prevent the actuator 60 from being tilted open.

Preferably, the cylindrical, upper wall 26 of the closure body 24 is provided with two, molded indentations: a first indentation 191 bearing the molded letter "C" and a second indentation 192 bearing the molded letter "O." The locking ring 120 has a single indentation with a molded, triangular shaped pointer 194 (FIGS. 1 and 2).

The locations of these molded features correspond to the "open" (unlocked) and "closed" (locked) positions of the locking ring 120. That is, when the locking ring 120 is positioned as illustrated in FIG. 1 so that the locking ring abutment member 168 (FIG. 7) prevents the actuator 60 from being tilted open, the locking ring pointer 194 is aligned with the closure body indentation 191 bearing the letter "C." On the other hand, when the locking ring pointer 194 is aligned with the closure body letter "O" in the indentation 192 (FIG. 2). This indicates to the user that the actuator 60 can be pressed to tilt it to the open, dispensing position.

Figure 10:
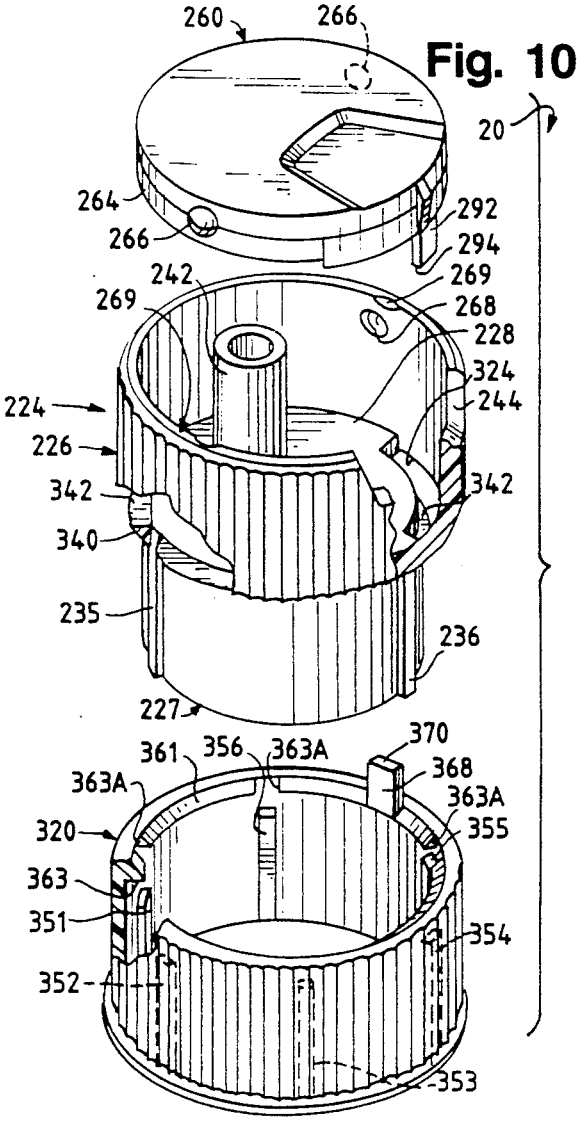
FIG. 10 is an enlarged, exploded, perspective view of another embodiment of the closure with portions of the structure cut away to reveal interior detail.

A second embodiment of the closure of the present invention is illustrated in FIGS. 10–14 wherein the closure is designated generally by the reference numeral 220 (FIG. 10). The closure 220 is adapted to be mounted on a container (not illustrated) which may have a conventional open mouth defined by a neck (not illustrated) or other suitable structure.

The closure 220 includes a closure base or body 224 (FIG. 10) for securement to the container. The body 224 includes a generally cylindrical, peripheral, upper wall 226 and a generally cylindrical, reduced-diameter, lower wall 227. A generally transverse closure wall or deck 228 extends across the body 224 between the upper wall 226 and lower wall 227.

Figure 12:
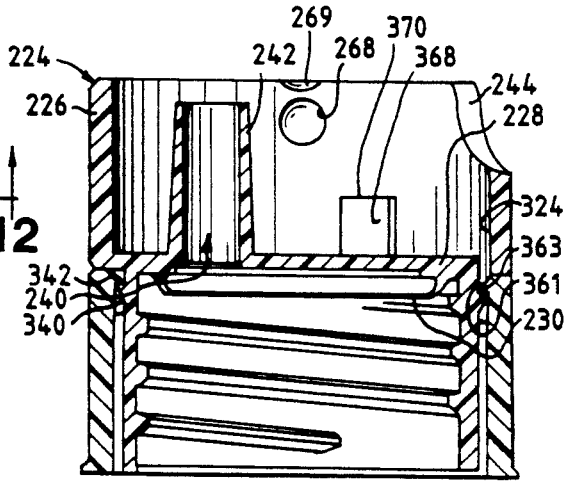
FIG. 12 is a cross-sectional view taken generally along the plane 12—12 in FIG. 11.
Figure 14:
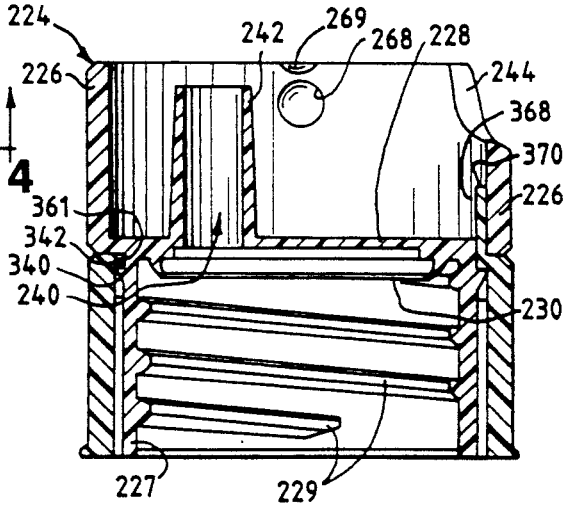
FIG. 14 is a cross-sectional view taken generally along the plane 14—14 in FIG. 13.

The lower, cylindrical wall 227 of the closure body 224 is adapted to engage the outer periphery of the top of the container neck (not illustrated) around the container mouth, as with threads 229 (FIGS. 12 and 14). Other suitable engaging means (e.g., snap-fit beads) may be provided to secure the closure body 224 on the container. Alternatively, in some applications the closure body 224 could be non-releasably attached to, or formed unitary with, the container.

An annular sealing ring 230 may be provided as shown in FIGS. 12 and 14 for engaging an interior edge of the container neck at the container mouth to effect a tight seal.

The closure body 224 includes a discharge aperture or passage 240 through the deck 228. In the preferred embodiment, the closure body 224 includes a discharge tube 242 projecting upwardly from the deck 228, and the discharge aperture 240 is defined within, and through, the tube 242. The discharge aperture 240 in the tube 242 communicates through the deck 228 with the container interior at the lower end of the tube 242.

The cylindrical, upper wall 226 of the closure body 224 extends upwardly above, and around, the closure body deck 228. A rear portion of the wall 226 above the deck 228 defines a fingerwell or finger recess area 244 in the form of a cutout or notch in the top edge of the wall 226.

The closure body 224 receives a generally disc-like nozzle assembly, actuator means, or actuator 260. The actuator 260 includes a transverse top wall 262 and a peripheral flange 264. At each of two diametrically opposed portions of the flange 264 there is a projecting, hemispherical protuberance or pivot member 266.

The pivot members 266 cooperate with the closure body upper wall 226 to mount the actuator 260 for pivoting movement within the closure body 224. To this end, the inner surface of the closure body wall 226 defines two hemispherical recesses 268 for each mating with one of the pivot members 266 to provide a snap-action engagement of the pivot member 266. This accommodates the pivoting movement of the actuator 260 about a pivot axis defined by the pivot members 266 and receiving recesses 268.

The top edge of the wall 226, above each recess 268, is preferably provided with a chamfer 269 for facilitating assembly. When the body 224 and actuator 260 are assembled, the actuator pivot members 266 and body recesses 268 function as mounting means so that the actuator 260 can be pivoted (by-pushing downwardly on the rear portion of the actuator 260) until the forward end is exposed above the closure body wall 226 (in a manner similar to that shown for the first embodiment actuator 60 illustrated in FIGS. 2, 3, and 9).

The actuator 260 has an internal structure identical to that of the first embodiment actuator 60 described above with reference to FIGS. 1–9. The internal structure functions, depending upon the orientation of the actuator 260, to either permit dispensing of flowable material from the body discharge tube 242 or occlude the tube passage 240 so as to prevent flow out of the discharge tube 242.

A locking tab 292 projects downwardly from the bottom of the peripheral flange 264 at the rear of the actuator 260. The locking tab 292 defines a downwardly facing engaging surface 294.

Figure 11:
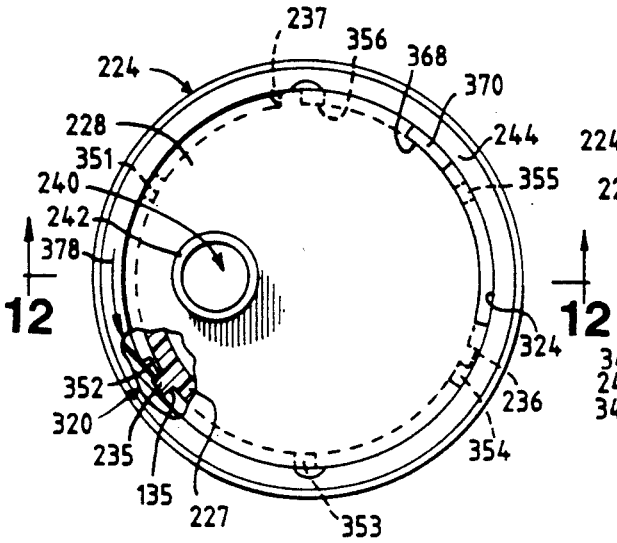
FIG. 11 is a plan view of the assembled body and locking ring shown partially in cross section.

A novel twist ring or locking ring 320 is adapted to be mounted to the closure body 224 for rotation relative to both the closure body 224 and container on which the closure body 224 is mounted. To this end, the closure body 224 is provided with a novel configuration for receiving and retaining the locking ring 320. In particular, as shown in FIGS. 10, 11, and 12, the closure body 224 defines one arcuate slot 324 at the junction of the deck 228 and cylindrical, upper wall 226. A portion of the slot 324 extends radially inwardly into the deck 228, and a portion of the slot 324 extends upwardly into a portion of the peripheral, upper, cylindrical wall 226. Because the closure body lower, cylindrical wall 227 has a smaller diameter than the upper wall 226, the slot 324 is open downwardly along side the closure deck 228 at the exterior surface of the lower, cylindrical wall 227.

On the exterior surface of the closure body cylindrical, lower wall 227 there are three, peripherally spaced, outwardly projecting ribs 235, 236 and 237 for engaging the locking ring 320 as explained in detail hereinafter. As can be seen in FIGS. 10 and 12, each body rib 235, 236, and 237 terminates somewhat below the body transverse deck 228. Above the top ends of the ribs 235, 236, and 237 the lower wall 227 flares outwardly to form a flange defined by a frustoconical lower surface 340 and an upwardly facing, annular bearing surface 342. The bearing surface 342 is spaced somewhat below the bottom surface of the body transverse deck 228.

The locking ring 320 has a generally cylindrical configuration. On the inside of the ring 320, as visible in FIG. 10, there are six ribs 351, 352, 353, 354, 355, and 356. The ribs 351–356 do not extend all the way to the top of the locking ring 320. At the top of the ring 320 there is an inwardly extending flange defined by a frustoconical surface 361 and a downwardly facing engaging surface 363. The flange surfaces 361 and 363 extend radially inwardly, but the flange is slotted, as at 363A, over the upper ends of each of the ribs 351–356 which are spaced below the surface 363. The slots 363A accommodate the tool configuration of the mold assembly used for molding the ring 320.

An abutment member 368 projects upwardly from the locking ring frustoconical surface 361. The top of the abutment member 368 defines an upwardly facing abutment surface 370 for being engaged by the downwardly facing engagement surface 294 of the actuator locking tab 292 as explained in detail hereinafter.

The locking ring 320 can be assembled with the closure body 224 before or after the actuator 260 has been mounted in the closure body 224. To this end, the locking ring 320 is aligned with the closure body cylindrical, lower wall 227, and then relative axial displacement is effected between the closure body 224 and the locking ring 320 so as to force the locking ring flange frustoconical surface 361 past the body flange frustoconical surface 340 by temporarily distorting or deforming one or both of the components. After sufficient axial displacement has been effected, the components are returned to their original shapes, owing to the inherent resiliency of the component materials, so that the locking ring flange engaging surface 363 overlies, and is supported by, the body bearing surface 342. This serves to retain the locking ring 320 on the closure body 224 while permitting the relative rotation between the ring 320 and body 224.

As the relative axial displacement is effected between the closure body 224 and the locking ring 320, the two components are aligned, by effecting relative rotation if necessary, so as to position the locking ring abutment tab 368 within the body slot 324. Thus, the abutment member 368 enters the body slot 324 and becomes positioned adjacent the cylindrical, upper wall 226 of the closure body 224 as illustrated in FIGS. 11–14.

The abutment member 368 is adapted to be positioned beneath the actuator tab 292 to prevent or block tilting of the actuator tab 260 to the open, dispensing position. This blocking action is effected by rotating the locking ring 320 in the direction of the arrow 376 in FIG. 13. This positions the abutment member 368 under the actuator tab 294. The engaging surface 294 of the actuator engaging tab 292 thus confronts the upwardly facing abutment surface 370 of the abutment member 368, and the actuator 260 cannot be tilted to the open position.

Figure 13:
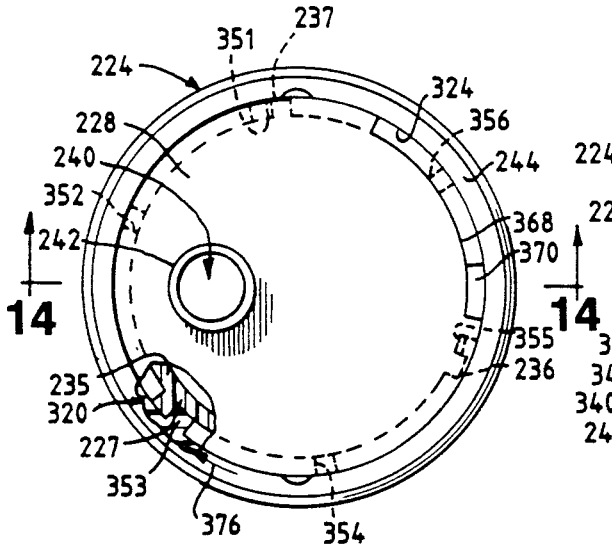
FIG. 13 is a view similar to FIG. 11 but showing the locking ring in a rotated orientation.

When the locking ring 320 is rotated to the locked, closed orientation as illustrated in FIGS. 13 and 14 to position the abutment member 368 for engaging the actuator tab 292, the locking ring ribs 351, 353, and 355 engage the body ribs 237, 235, and 236, respectively. This prevents the locking ring 320 from being rotated further at the appropriate point where the abutment member 368 aligned below the actuator engaging tab 292 to prevent opening of the actuator 260.

On the other hand, the locking ring 320 can be rotated in the other direction, in the direction of the arrow 378 as illustrated in FIG. 11, to permit the actuator 260 to be tilted to the open position. The locking ring 320 can be rotated in the direction of the arrow 378 until the locking ring ribs 352, 354, and 356 engage the body ribs 235, 236, and 237, respectively. This prevents further rotation of the locking ring 320 at a point where the abutment member 368 has been moved sufficiently far from the actuator tab 292 to permit the actuator 260 to be tilted open.

At each end of the range of rotation of the ring 320 where the ring ribs engage the body ribs, such rib engagement serves to provide a tactile indication that the components have been moved to the end of the movement range which either permits or prevents the tilting of the actuator 260 to the open position.

If desired, the cylindrical outer wall 226 of the closure body 224 may be provided with two, molded indentations such as the indentations having the molded letters "C" and "O" as employed in the first embodiment illustrated in FIGS. 1 and 2 discussed above. In such a case, the locking ring 320 may be provided with a single indentation containing an appropriate indicium for being selectively aligned with one of the two indentations in the closure body so as to provide a visual indication of the locked condition or unlocked condition.

In the illustrated embodiment, where the closure body 224 is provided with threads 229 for threadingly engaging mating threads on a container neck (not illustrated), the closure body ribs and ring ribs facilitate the screwing of the closure onto the container with or without an automatic capping machine. In particular, the locking ring 320 can be gripped, as with the head of an automatic capping machine, to align the closure, and hence the closure body lower wall 227, with the container neck. As the closure body threads 29 engage the threads on the container neck, the capping machine rotates the locking ring 320 (in a clockwise direction when viewing downwardly on the top of the closure). The locking ring ribs move with the ring 320 relative to the closure body 224 until the leading ring ribs 351, 353, and 355 engage the body ribs 237, 235, and 236, respectively. This establishes a driving engagement between the locking ring 320 and closure body 224 which threads the closure tightly onto the container with the closure initially in the locked closed orientation.

The closure of the present invention can be readily molded from thermoplastic materials and easily assembled to provide a stream-lined product. The closure provides a desirable toggle-action dispensing operation and at the same time includes a lock for preventing, or reducing the likelihood of, an inadvertent, premature opening or actuation of the closure to the dispensing position.

It will be readily apparent from the foregoing detailed description of the invention and from the illustrations thereof that numerous variations and modifications may be effected without departing from the true spirit and scope of the novel concepts or principles of this invention.

What is claimed is:

1. A toggle-action dispensing closure for an opening to a container, said closure comprising:

a body for engaging said container over said opening;

an actuator means on said body for occluding flow from said container when said actuator means is in a closed non-dispensing position and for permitting flow from said container when said actuator means is tilted to an open dispensing position, said actuator means including a top wall defining an actuating surface that can be pushed by a finger, said actuator means including a downwardly facing engaging surface below said top wall;

mounting means defined by said body and actuator means for pivotally mounting said actuator means on said body forwardly of said actuating surface to accommodate pivoting movement of said actuator means between said closed position and said open position in response to a force applied to said actuating surface while preventing substantial relative rotational movement between said body and actuator means about a central axis; and a locking ring mounted on said body for rotation relative to said body and actuator means about said central axis, said ring defining an upwardly projecting and upwardly facing abutment surface whereby rotation of said ring to a first orientation carries said abutment surface into alignment with said actuator means engaging surface to prevent tilting of said actuator means to said open dispensing position and rotation of said ring away from said first orientation carries said abutment surface out of alignment with said engaging surface to permit tilting of said actuator means to said open dispensing position.

2. The closure in accordance with claim 1 in which said mounting means comprises a portion of said body which includes a pair of spaced-apart recesses each defining an engaging surface that is at least partially spherical;

said body defines a discharge aperture in communication with said container opening; and said actuator means defines a dispensing passage for communicating with said body discharge aperture when said actuator means is in said open position, said actuator means further having a pair of spaced-apart bearing members each defining a bearing surface that is at least partially spherical for engaging one of said body recesses to accommodate tilting of said actuator means relative to said body between said open and closed positions.

3. The closure in accordance with claim 1 in which said body has a cylindrical, exterior surface bearing two spaced-apart indicia; and said locking ring has an exterior surface with an indicium for being selectively aligned with each of said body indicia.

4. The closure in accordance with claim 1 in which said body includes an annular flange having an upwardly facing bearing surface; and said locking ring includes an annular flange having a downwardly facing engaging surface for engaging said body flange bearing surface.

5. The closure in accordance with claim 1 in which said closure body includes a cylindrical lower wall with a plurality of circumferentially spaced, outwardly projecting ribs each aligned parallel to the cylindrical lower wall longitudinal axis;

said locking ring defines a cylindrical inner surface and a plurality of circumferentially spaced ribs projecting inwardly from said inner surface; and said locking ring ribs are each aligned parallel to the ring longitudinal axis whereby said ring ribs can engage said body ribs to limit relative rotation between said body and said ring.

6. A toggle-action dispensing closure for an opening to a container, said closure comprising:

a body for engaging said container over said opening, said body having a cylindrical, upper wall and a reduced diameter cylindrical, lower wall, said body defining a transverse deck connecting the top of said body lower wall with the bottom of said body upper wall, said body deck having a top surface, and said body defining a plurality of arcuate slots spaced-apart in said deck and upper wall;

an actuator means on said body for occluding flow from said container when said actuator means is in a closed non-dispensing position and for permitting flow from said container when said actuator means is tilted to an open dispensing position, said actuator means including an engaging surface;

mounting means defined by said body and actuator means for pivotally mounting said actuator means on said body to accommodate pivoting movement of said actuator means between said closed position and said open position in response to a force applied to said actuator means about a central axis; and a locking ring mounted on said body for rotation relative to said body and actuator means about said central axis, said ring defining an abutment surface whereby rotation of said ring to a first orientation carries said abutment surface into alignment with said actuator means engaging surface to prevent tilting of said actuator means to said open dispensing position and rotation of said ring away from said first orientation carries said abutment surface out of alignment with said engaging surface to permit tilting of said actuator means to said open dispensing position, said locking ring including a plurality of hook-shaped clips each extending through one of said slots to engage said deck top surface and retain said ring on said closure body around said body lower wall.

7. The closure in accordance with claim 6 in which one of said clips has an upwardly extending abutment member defining said abutment surface.

8. The closure in accordance with claim 6 in which said body transverse deck defines a top surface and said body includes a plurality of protrusions which project upwardly from said body transverse deck top surface and which are spaced apart in a circular array; and each said clip has a shape for engaging one of said protrusions in a snap-fit engagement.

9. The closure in accordance with claim 8 in which each said protrusion has a semi-cylindrical shape; and each said clip has a downwardly directed distal end surface defining a partially cylindrical shape for matingly engaging one of said protrusions.

10. The closure in accordance with claim 6 in which said closure body cylindrical lower wall has a plurality of circumferentially spaced, outwardly projecting ribs each aligned parallel to the cylindrical lower wall longitudinal axis;

said locking ring defines a cylindrical inner surface and a plurality of circumferentially spaced ribs projecting inwardly from said inner surface; and said locking ring ribs are each aligned parallel to the ring longitudinal axis whereby said ring ribs can engage said body ribs to limit relative rotation between said body and said ring.

11. A toggle-action dispensing closure for an opening to a container, said closure comprising:

a body for engaging said container over said opening, said body having a cylindrical, upper wall and a reduced diameter cylindrical, lower wall, said body defining a transverse deck connecting the top of said body lower wall with the bottom of said body upper wall, said body defining an arcuate slot in said deck and upper wall;

an actuator means on said body for occluding flow from said container when said actuator means is in a closed non-dispensing position and for permitting flow from said container when said actuator means is tilted to an open dispensing position, said actuator means including an engaging surface;

mounting means defined by said body and actuator means for pivotally mounting said actuator means on said body to accommodate pivoting movement of said actuator means between said closed position and said open position in response to a force applied to said actuator means while preventing substantial relative rotational movement between said body and actuator means about a central axis; and a locking ring mounted on said body for rotation relative to said body and actuator means about said central axis, said ring defining an abutment surface whereby rotation of said ring to a first orientation carries said abutment surface into alignment with said actuator means engaging surface to prevent tilting of said actuator means to said open dispensing position and rotation of said ring away from said first orientation carries said abutment surface out of alignment with said engaging surface to permit tilting of said actuator means to said open dispensing position, said locking ring including an upwardly extending abutment member that defines said abutment surface and that extends through said slot to engage said actuator engaging surface.

12. A toggle-action dispensing closure for an opening to a container, said closure comprising:

a body for engaging said container over said opening, said body defining a discharge aperture in communication with aid opening;

an actuator on said body having flow control means for occluding flow from said body discharge aperture when said actuator is in a closed non-dispensing position and for permitting flow through said body discharge aperture from said container when said actuator is in an open dispensing position, said actuator including a top wall defining an actuating surface that can be pushed by a finger, said actuator including a downwardly depending engaging tab defining a downwardly facing engaging surface below said top wall;

mounting means defined by said body and actuator for pivotally mounting said actuator means on said body forwardly of said actuating surface to accommodate pivoting movement of said actuator between said closed position and said open position in response to a force applied to said actuating surface while preventing substantial relative rotational movement between said body and actuator means about a central axis; and a locking ring mounted on said body for rotation relative to said body and actuator about said central axis, said ring defining an upwardly projecting abutment member that defines an upwardly projecting and upwardly facing abutment surface whereby rotation of said ring to a first orientation carries said abutment member into alignment with said actuator engaging tab so that said engaging surface confronts said abutment surface to prevent tilting of said actuator to said open dispensing position and rotation of said ring away from said first orientation carries said abutment member out of alignment with said engaging tab to permit tilting of said actuator to said open dispensing position.

* * * * *

UNITED STATES PATENT AND TRADEMARK OFFICE

CERTIFICATE OF CORRECTION

PATENT NO. : 5,314,093

DATED : May 24, 1994

INVENTOR(S) : Richard A. Gross, et al.

It is certified that error appears in the above-indentified patent and that said Letters Patent is hereby corrected as shown below:

Column 11, line 1, "29" should be -- 229 --;

Column 12, line 55, after "means" insert -- while preventing substantial relative rotational movement between said body and actuator--2nd occur) means --; and Column 14, line 20, "aid" should be -- said --.

Signed and Sealed this

First Day of November, 1994

*Attest:*

*Attesting Officer*

Bruce Lehman

BRUCE LEHMAN

*Commissioner of Patents and Trademarks*